United States Patent [19]

Allfather

[11] Patent Number: 4,510,354

[45] Date of Patent: Apr. 9, 1985

[54] CURRENT TAP SELECTING SWITCH

[75] Inventor: Lars P. Allfather, Guilderland, N.Y.

[73] Assignee: Doble Engineering Company, Watertown, Mass.

[21] Appl. No.: 599,463

[22] Filed: Apr. 12, 1984

[51] Int. Cl.[3] ..... H01H 19/54

[52] U.S. Cl. ..... 200/11 R; 200/11 TC

[58] Field of Search ..... 200/11 R, 11 TW, 61.19, 200/51 R, 11 TC; 307/112, 113

[56] References Cited

U.S. PATENT DOCUMENTS 3,757,062 9/1973 Lipschutz ..... 200/61.19 X 4,158,114 6/1979 Butler et al. ..... 200/11 R X

FOREIGN PATENT DOCUMENTS 2829860 1/1980 Fed. Rep. of Germany ... 200/61.19

*Primary Examiner*—J. R. Scott

*Attorney, Agent, or Firm*—Charles Hieken

[57] ABSTRACT

Six high-current conducting receptacles are seated in a panel suitably insulated therefrom about an opening embracing an axis of a shaft protruding therethrough of a six-position detented rotary switch. Three equiangularly spaced studs support a tap select dial formed with an opening that selectively exposes one of the receptacles at a time and a central opening accommodating the shaft of a switch adapter below connected to the rotary switch shaft and maintained in fixed relationship with the rotary switch shaft and the tap select dial. The shaft of the switch adapter extending through the central opening in the tap select dial carries a knob. A connector plug may pass through the opening in the tap select dial for engagement with the exposed receptacle.

4 Claims, 1 Drawing Figure

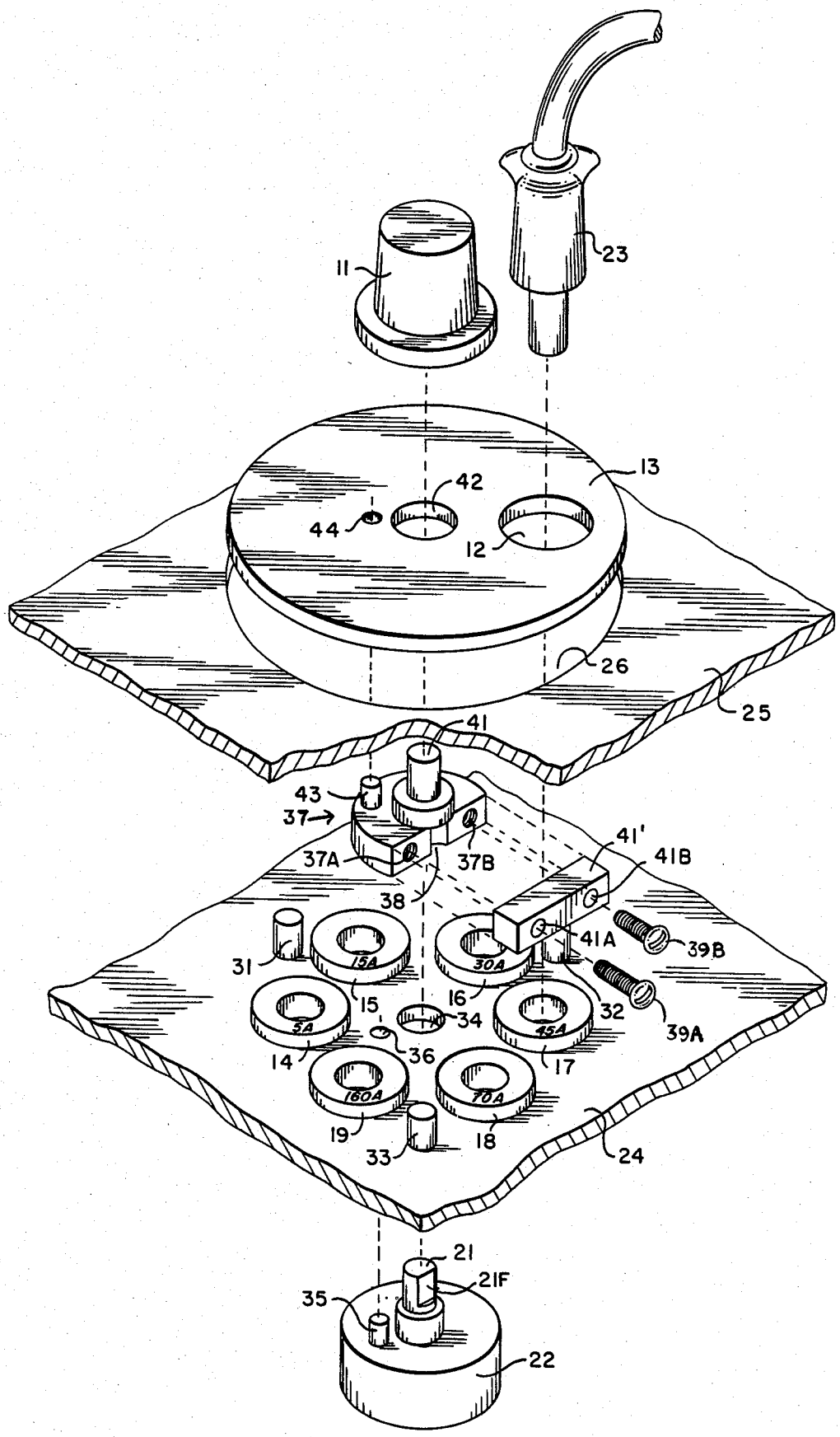
11
23
13
42
44
12
26
25
41
43
37
37A
37B
41'
41B
38
41A
39B
31
15A
30A
16
32
39A
15
34
5A
45A
14
36
17
160A
70A
19
18
33
24
21
21F
35
22

CURRENT TAP SELECTING SWITCH

BACKGROUND OF THE INVENTION

The present invention relates in general to current tap selecting and more particularly concerns novel apparatus and techniques for selecting a tap on a control current source, providing a signal to the controlled current source indicating the selected tap and exposing only the selected tap.

It is an important object of the invention to provide improved methods and means for selecting a current tap from a controlled current source and providing a signal to the current source indicating the tap selected.

SUMMARY OF THE INVENTION

According to the invention, there are a plurality of connector terminal meas for receiving an external connector displaced along a path and preferably angularly disposed about an axis. A cover plate, preferably rotatable about the axis, is formed with an opening, preferably radially displaced from the axis, so as to selectively expose a selected one of the terminal means while covering the others to thereby allow the external connector to engage only the terminal means exposed through the opening. A switch, preferably a rotary switch having its axis of rotation along the axis, has its actuating shaft mechanically coupled to the cover plate so that movement of the cover plate is accompanied by movement of the switch shaft to move the switch to a position corresponding to the exposed one of the terminal means and thereby provide a means for sending a low power signal through the switch to the current source indicating the terminal means then exposed through the cover plate opening.

BRIEF DESCRIPTION OF THE DRAWING

Numerous other features, objects and advantages of the invention will become apparent from the following specification when read in connection with the accompanying drawing, the single FIGURE of which is an exploded view of an embodiment of the invention.

DETAILED DESCRIPTION OF PREFERRED EMBODIMENTS

With reference now to the drawing, there is shown an exploded view of an exemplary embodiment of the invention. An operator rotates knob 11 to position the opening 12 in tap select dial or cover plate 13 over a selected one of the tap receptacles or current terminals 14–19 and synchronously displacing shaft 21 of 6-position rotary switch 22 to expose only one of the receptacles for engagement with connector plug 23 to connect an external load (not shown) to a corresponding tap of the current source (not shown).

The current terminals 14–19 are suitably insulated and seated in control panel 24 fragmentarily illustrated covered by fragmentarily illustrated control panel cover 25 formed with an opening 26 that exposes the current receptacles or terminals 14–19 and the three tap select dial supports 31, 32 and 33 upon which tap select dial 13 rides while rotated.

The shaft 21 of rotary switch 22 passes through opening 34 centered along the axis of the assembly. Rotary switch 22 is formed with a stud 35 that seats in opening 36 in control panel 24 to keep the main body of rotary switch 22 stationary as shaft 21 rotates.

Switch adapter 37 engages shaft 21 of rotary switch 22 in the arcuate portion 38. Switch adapter bar clamp 41' engages the flat 21F of shaft 21 and is fastened to switch adapter 37 with screws 39A and 39B that engage tapped openings 37A and 37B and pass through openings 41A and 41B. Switch adapter 37 has a shaft 41 that passes through opening 42 in tap select dial 13 to which knob 11 is fastened. Switch adapter 37 has an upstanding stud 43 that resides in opening 44 of tap select dial 13 so that rotation of knob 11 produces rotation of switch adapter 37 which in turn produces synchronous rotation of tap select dial 13 and rotary switch shaft 21.

While various materials may be used for the different components, translucent plexiglass is suitable for dial 14, and aluminum is suitable for control panel 24 and control panel cover 25.

In the specific example shown, there are six taps for providing maximum currents of 5 amps, 15 amps, 30 amps, 45 amps, 70 amps and 160 amps, respectively, and switch 22 is a six-position detented rotary switch aligned so that each of its stable detented positions results in opening 12 exposing a corresponding one of terminals 14–19. Connector plug 23 may then be inserted through opening 12 into engagement with the exposed receptacle and thereby carry current up to the associated maximum value to an external load. Thus, the invention use the detent of the attached low power rotary switch to also provide the desired detenting action for tap select dial 13.

The invention represents an elegant solution to a difficult problem. Since the maximum output currents at the respective taps range from 5 to 160 amperes, directly switching the output with a switch or relay would require a bulky costly switch or set of relays. This added bulk and weight is a serious disadvantage in a portable system comprising the invention. Taps or ranges are necessary for the current source in order to match the impedance of the load with the tap of the output transformer of the current source closely to achieve efficient operation.

The invention provides these taps in a compact reliable relatively inexpensive relatively safe structure that insures that the user can only plug into one tap at a time, and only that tap exposed by opening 12 of select dial 13. By connecting select dial 13 to a standard six-position rotary switch, the latter may provide an electrical conducting path for transmitting at low power a signal to a microprocessor or other control circuitry to provide the current source a signal representative of which tap has been selected to enable the current source to make appropriate adjustments, such as in one or more feedback paths, to enhance operation for the particular current range selected.

The invention and associated current source is embodied in the commercially available F2 test system available from the assignee of this invention, Doble Engineering Co. of Watertown, Mass. The disclosure of that commercially available test system is incorporated herein by reference.

The current source is also described in copending application Ser. No. 553,768 filed Nov. 21, 1983, of the inventor of this invention owned by the assignee of this invention and also incorporated herein by reference.

There has been described novel apparatus and techniques for enabling a user to select a particular tap of a current source while signaling to the controlled current source the selected tap and insuring that the user makes connection to the selected tap with a reliable connection.

It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Apparatus for selecting a tap of a high power current source and providing a signal representative of the tap selected comprising, a plurality of terminal means for carrying current, means for supporting said plurality of terminal means spaced along a predetermined path and equiangularly disposed about an axis for connection to a respective tap of the current source and for receiving an external connector for connection to an external load, tap select means formed with an opening for selectively exposing one of said terminal means while covering the others, a rotary switch having its shaft centered about said axis comprising an actuating member mechanically connected to said tap select means for providing an electrical signal representative of the terminal means then exposed by said opening and electrically isolated from said and means for displacing said tap select means relative to said terminal means to move said opening to positions exposing any selected one of said terminal means while correspondingly moving said actuating member to enable said rotary switch to provide an electrical conducting path representative of the terminal means then exposed by said opening.

2. Apparatus in accordance with claim 1 and further comprising, panel means for supporting said terminal means, said panel means carrying stud means for supporting said tap select means, means for securing said rotary switch to the underside of said panel means with the body thereof in fixed relationship thereto and the shaft thereof extending above said panel means through an opening therein embracing said axis, and switch adapter means fastened to the rotary switch shaft and said tap select means for maintaining the rotary switch shaft and said tap select means in fixed relationship so that the angular orientation of said shaft about said axis is representative of the exposed terminal means.

3. Apparatus in accordance with claim 2 wherein said switch adapter means is formed with a shaft passing through an opening in said tap select means embracing said axis and further comprising, knob means attached to the latter shaft for rotating the latter shaft and the elements in fixed relationship therewith.

4. Apparatus in accordance with claim 3 and further comprising, a connector plug for mating engagement with an exposed one of said terminal means through the opening in said tap select means for establishing connection with an external load.

* * * * *